US009846003B2

(12) United States Patent
Hwang

(10) Patent No.: US 9,846,003 B2
(45) Date of Patent: Dec. 19, 2017

(54) CHARGING HANDLE WITH AMBIDEXTROUS LATCH AND INTERCHANGEABLE HANDLES

(71) Applicant: RAINIER ARMS, LLC, Auburn, WA (US)

(72) Inventor: John J. Hwang, Kent, WA (US)

(73) Assignee: RAINIER ARMS, LLC, Auburn, WA (US)

( * ) Notice: Subject to any disclaimer, the term of this patent is extended or adjusted under 35 U.S.C. 154(b) by 50 days.

(21) Appl. No.: 15/053,425

(22) Filed: Feb. 25, 2016

(65) Prior Publication Data

US 2016/0298917 A1 Oct. 13, 2016

Related U.S. Application Data

(60) Provisional application No. 62/143,981, filed on Apr. 7, 2015.

(51) Int. Cl.

| | |
|---|---|
| ***B64D 1/04*** | (2006.01) |
| ***F41A 3/72*** | (2006.01) |
| ***F41A 35/06*** | (2006.01) |

(52) U.S. Cl.
CPC ..... *F41A 3/72* (2013.01); *F41A 35/06* (2013.01)

(58) Field of Classification Search
USPC ..... 89/1.4; 42/43
See application file for complete search history.

(56) References Cited

U.S. PATENT DOCUMENTS 7,832,322 B1 * 11/2010 Hoel ..... F41A 3/20 42/16
8,960,066 B2 * 2/2015 Gomez ..... F41A 3/72 42/43

* cited by examiner

*Primary Examiner* — J. Woodrow Eldred
(74) *Attorney, Agent, or Firm* — Eversheds Sutherland (US) LLP

(57) ABSTRACT

A charging handle is disclosed. The charging handle may include an elongated body having a forward end and a rear end, a handle assembly disposed about the rear end of the elongated body, and a latch assembly disposed about the rear end of the elongated body in mechanical communication with the handle assembly. The charging handle may include an ambidextrous latch and/or interchangeable handles.

17 Claims, 6 Drawing Sheets

CHARGING HANDLE WITH AMBIDEXTROUS LATCH AND INTERCHANGEABLE HANDLES

CROSS-REFERENCE TO RELATED APPLICATIONS

The disclosure claims priority to and the benefit of U.S. provisional application No. 62/143,981, filed Apr. 7, 2015, which is herein incorporated by reference in its entirety.

FIELD OF THE DISCLOSURE

The disclosure generally relates to firearms and more particularly relates to a charging handle with an ambidextrous latch and interchangeable handles.

BACKGROUND

A charging handle may be used to manually manipulate a bolt carrier of a firearm. For example, the charging handle may be used to clear malfunctions and as a means to retract the bolt carrier for inspection of the firearm.

SUMMARY

Some or all of the above needs and/or problems may be addressed by certain embodiments of the charging handle disclosed herein. According to one embodiment, the charging handle may include an elongated body having a forward end and a rear end, a handle assembly disposed about the rear end of the elongated body, and a latch assembly disposed about the rear end of the elongated body in mechanical communication with the handle assembly. The charging handle may include an ambidextrous latch and/or interchangeable handles.

Other features and aspects of the charging handle will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 2:
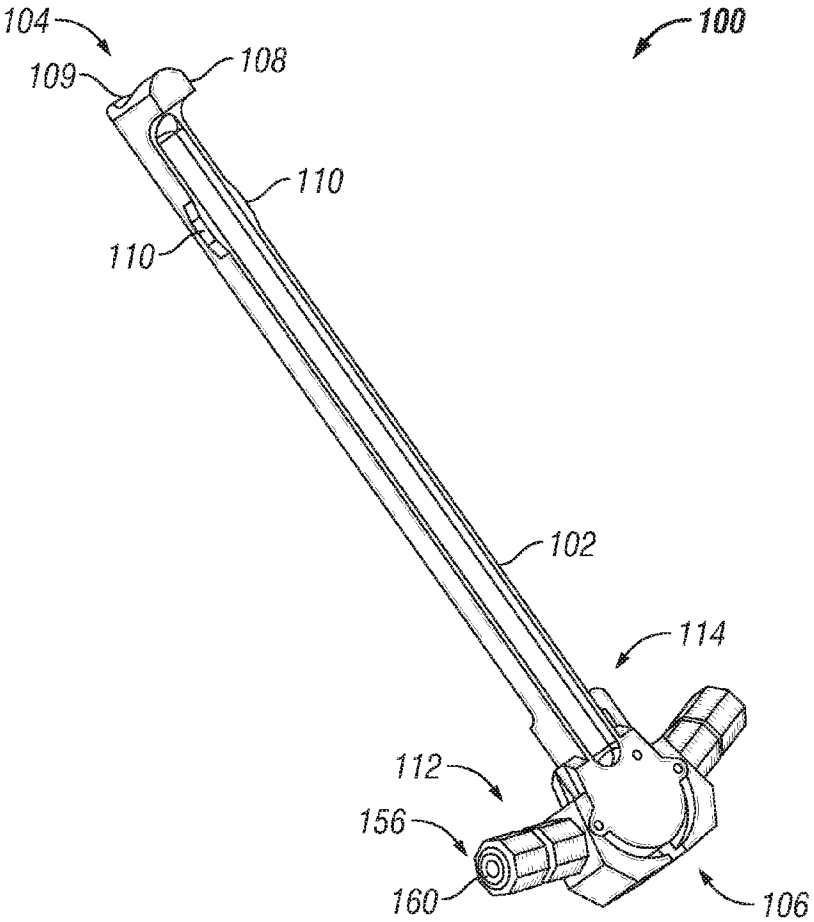
FIG. 2 depicts a perspective view of a charging handle in accordance with one or more embodiments of the disclosure.
Figure 1:
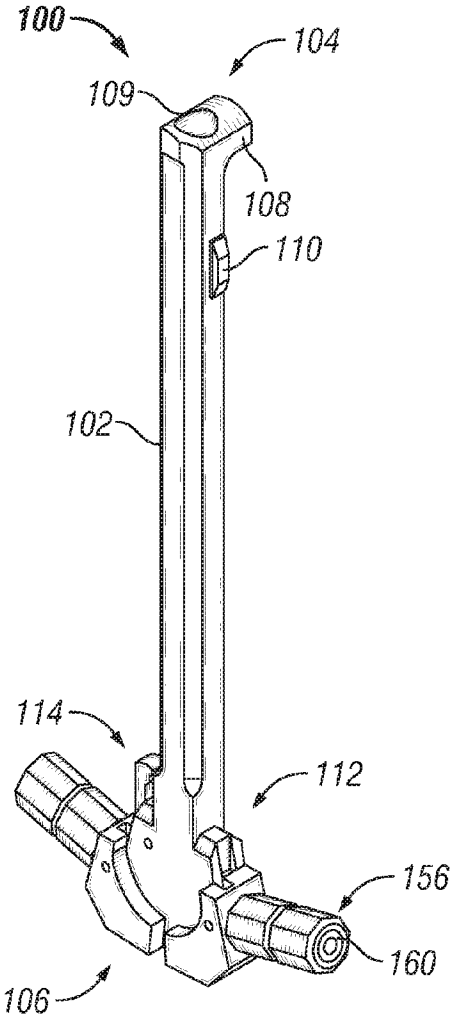
FIG. 1 depicts a perspective view of a charging handle in accordance with one or more embodiments of the disclosure.
Figure 3:
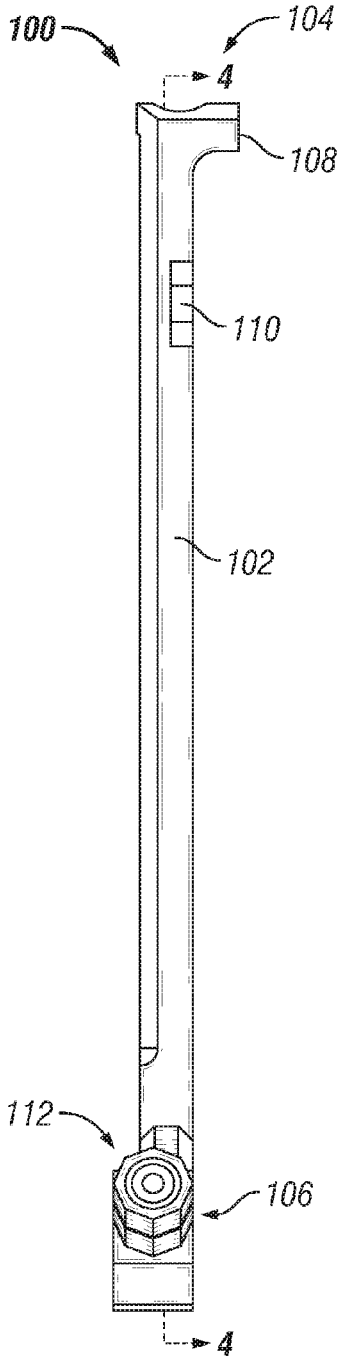
FIG. 3 depicts a side view of a charging handle in accordance with one or more embodiments of the disclosure.
Figure 4:
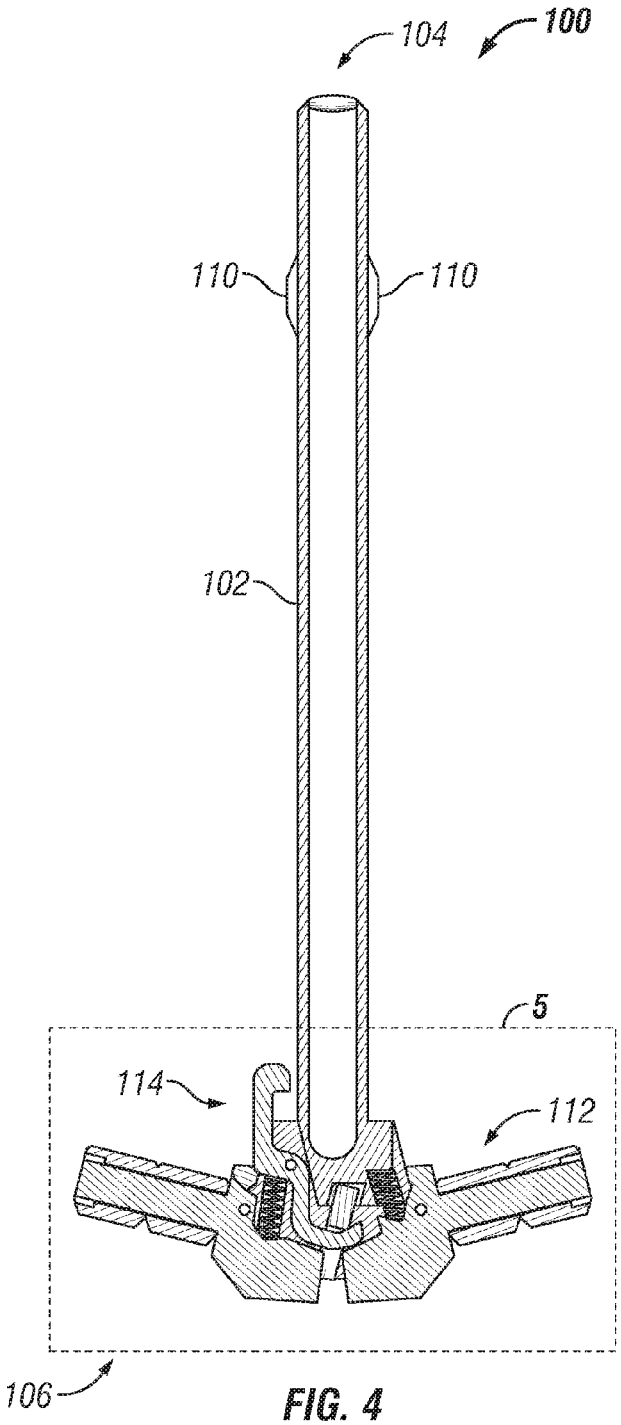
FIG. 4 depicts a cross-sectionals view of a charging handle in accordance with one or more embodiments of the disclosure.

Described below are embodiments of a charging handle (as well as individual components of the charging handle) that can be attached to a firearm. Methods of installing and using the charging handle on the firearm are also disclosed. The firearm may be a conventional firearm. For example, the firearm may be an M-16 style rifle, an AR-15 style rifle, an AR-10 style rifle, or an M-4 style rifle, among others. The charging handle may be used with any type of firearm, including rifles and/or pistols.

Generally speaking, the charging handle may include an elongated body having a forward end and a rear end. A handle assembly may be disposed about the rear end of the elongated body. In addition, a latch assembly may be disposed about the rear end of the elongated body. The latch assembly may be in mechanical communication with the handle assembly. The latch assembly may include a latch pivotably attached to the handle assembly. The latch may be moved between a closed position and an open position. The latch assembly also may include a spring configured to bias the latch in the closed position.

The handle assembly may include a first handle pivotable attached to a first side of the handle assembly. Similarly, the handle assembly may include a second handle pivotable attached to a second side of the handle assembly opposite the first handle. The first handle may be configured to move the latch between the open position and the closed position as the first handle is rotated independent of the second handle. Likewise, the second handle may be configured to move the latch between the open position and the closed position as the second handle is rotated independent of the first handle. That is, a user may manipulate (e.g., pivot) the first handle, the second handle, or both to move the latch between the open position and the closed position. In some instances, the second handle may include a stop configured to engage an end of the latch to prevent over rotation of the latch beyond the open configuration.

The charging handle may include interchangeable handles. That is, the first handle, the second handle, and/or components thereof may be removed and replaced with a different handle. In this manner, a user may swap out different handles or portions thereof as desired. For example, the first handle, the second handle, or both may include a removable outer handle portion attachable to an inner handle portion. In some instances, the inner handle portion may include an outwardly extending protrusion, and the removable outer handle portion may include an aperture therein configured to mate with the outwardly extending protrusion. In addition, a fastener may be used to removably fasten the removable outer handle portion to the inner handle portion. Other types of attachment configurations are also possible.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

FIGS. 1-6B schematically depict a charging handle 100 (as well as individual components of the charging handle 100) that can be attached to a firearm in accordance with one or more embodiments of the disclosure. As depicted in FIGS. 1-4, the charging handle may include an elongated body 102 having a forward end 104 and a rear end 106. The forward end 104 of the elongated body 102 may include a hook 108 configured to engage a bolt or the like. The hook 108 may include a hole 109 extending therethrough. The forward end 104 of the elongated body 102 also may include lugs 110 extending outwardly from the sides of the elongated body 102.

The charging handle 100 may include a handle assembly 112. The handle assembly 112 may be disposed about the rear end 106 of the elongated body 102. In addition, a latch assembly 114 may be disposed about the rear end 106 of the elongated body 102. The latch assembly 114 may be in mechanical communication with the handle assembly 112. That is, the latch assembly 114 and the handle assembly 112 may be mechanically coupled.

Figure 5:
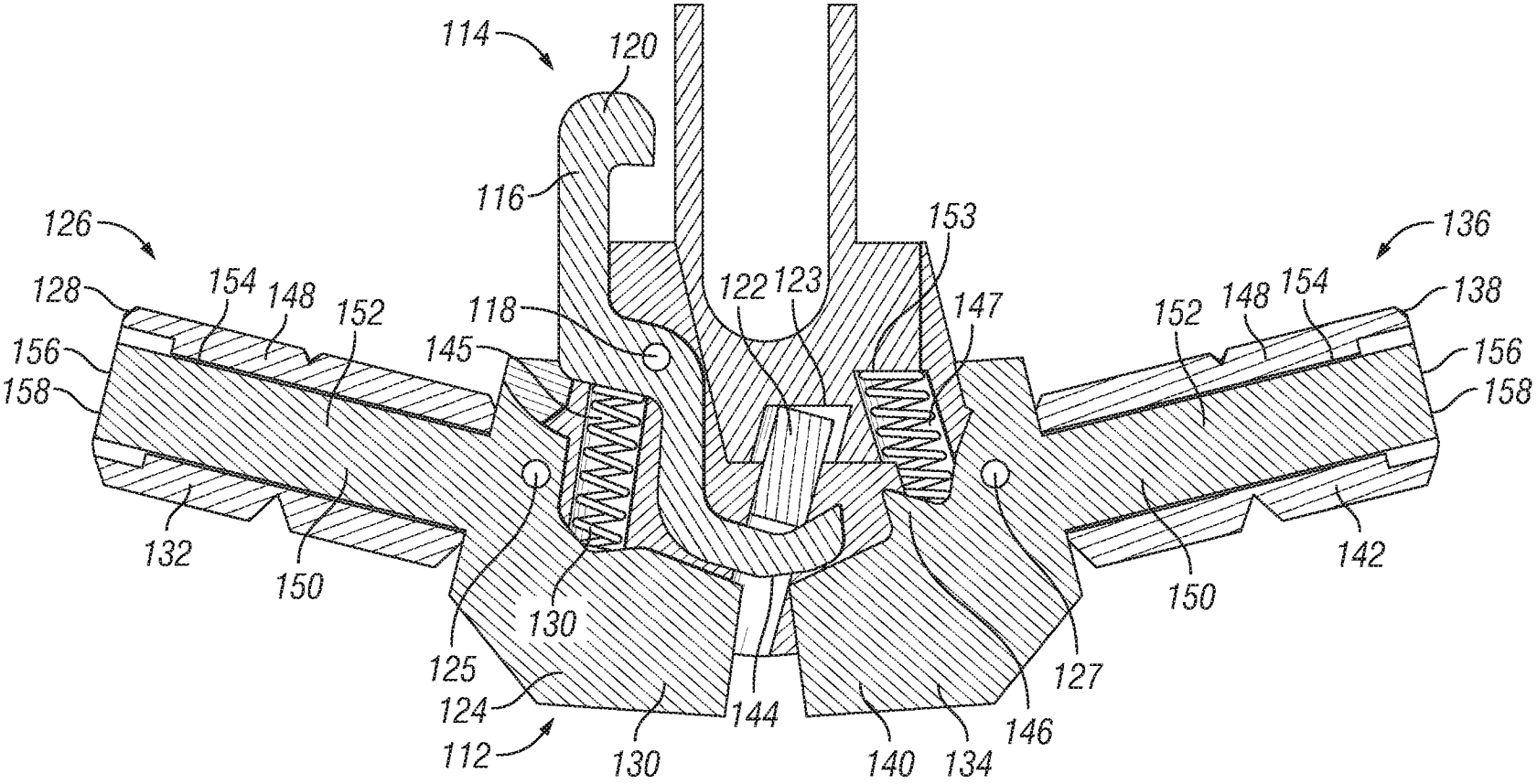
FIG. 5 depicts a partial a cross-sectional view of a charging handle in accordance with one or more embodiments of the disclosure.

As depicted in FIG. 5, the latch assembly 114 may include a latch 116 pivotably attached to the handle assembly 112. For example, the latch 116 may include a pivot 118 disposed between its ends. In some instances, one end of the latch 116 may include a catch 120 (e.g., a hook or the like). The latch 116 may be moved between a closed position and an open position. The latch assembly 114 also may include a spring 122 configured to bias the latch 116 in the closed position. The spring 122 may be disposed within a spring slot 123. The spring 122 may engage an end 144 of the latch 116 opposite the catch 120 on the catch 120 side of the latch 116.

The handle assembly 112 may include a first handle 124 pivotable attached to a first side 126 of the handle assembly 112. For example, the first handle 124 may be attached to the handle assembly 112 by pivot 125. The first handle 124 may include a first end 128 and a second end 130. The first end 128 of the first handle 124 may include a knob 132 or the like configured to be manipulated by a user. Similarly, the handle assembly 112 may include a second handle 134 pivotable attached to a second side 136 of the handle assembly 112 opposite the first handle 124. For example, the second handle 134 may be attached to the handle assembly 112 by pivot 127. The second handle 134 may include a first end 138 and a second end 140. The first end 138 of the second handle 134 may include a knob 142 or the like configured to be manipulated by a user.

The first handle 124 may be configured to move the latch 116 between the open position and the closed position as the first handle 124 is rotated about pivot 125. For example, as the first handle 124 is rotated, the second end 130 of the first handle 124 may engage the end 144 of the latch 116 opposite the catch 120, which may pivot the latch 116 from the closed position to the open position about the pivot 118. The first handle 124 may move the latch 116 between the open position and the closed position independent of the second handle 134. Likewise, the second handle 134 may be configured to move the latch 116 between the open position and the closed position as the second handle 134 is rotated. For example, as the second handle 134 is rotated, the second end 140 of the second handle 134 may engage the end 144 of the latch 116 opposite the catch 120, which may pivot the latch 116 from the closed position to the open position about the pivot 118. The second handle 134 may be configured to move the latch 116 between the open position and the closed position independent of the first handle 124. In this manner, a user may manipulate (e.g., pivot) the first handle 124, the second handle 134, or both to move the latch 116 between the open position and the closed position.

A first handle spring 151 may be disposed within a first handle spring slot 145 so as to bias the first handle 124 in the closed configuration. In this manner, in some instances, the first handle 124 may stay in the closed position as the second handle 134 is moved to actuate the latch 116 between the closed and open positions. Similarly, a second handle spring 153 may be disposed within a second handle spring slot 147 so as to bias the second handle 134 in the closed configuration. In this manner, in some instances, the second handle 134 may stay in the closed position as the first handle 124 is moved to actuate the latch 116 between the closed and open positions. Accordingly, the first handle 124 and the second handle 134 may move the latch 116 between the open and closed positions independent of each other.

In some instances, the second handle 134 may include a stop 146. The stop 146 may be disposed about the second end 140 of the second handle 134. The stop 146 may be configured to engage the end 144 of the latch 116 opposite the catch 120 to prevent over rotation of the latch 116 beyond the open configuration. For example, as the first handle 124 and/or the second handle 134 are rotated to move the latch 116 from the closed position to the open position, the stop 146 may be configured to engage the end 144 of the latch 116 opposite the catch 120 to prevent over rotation of the latch 116 beyond the open configuration. The stop 146 may be any protrusion, lip, ledge, or nub disposed about the send end 140 of the second handle 134.

Figure 6A:
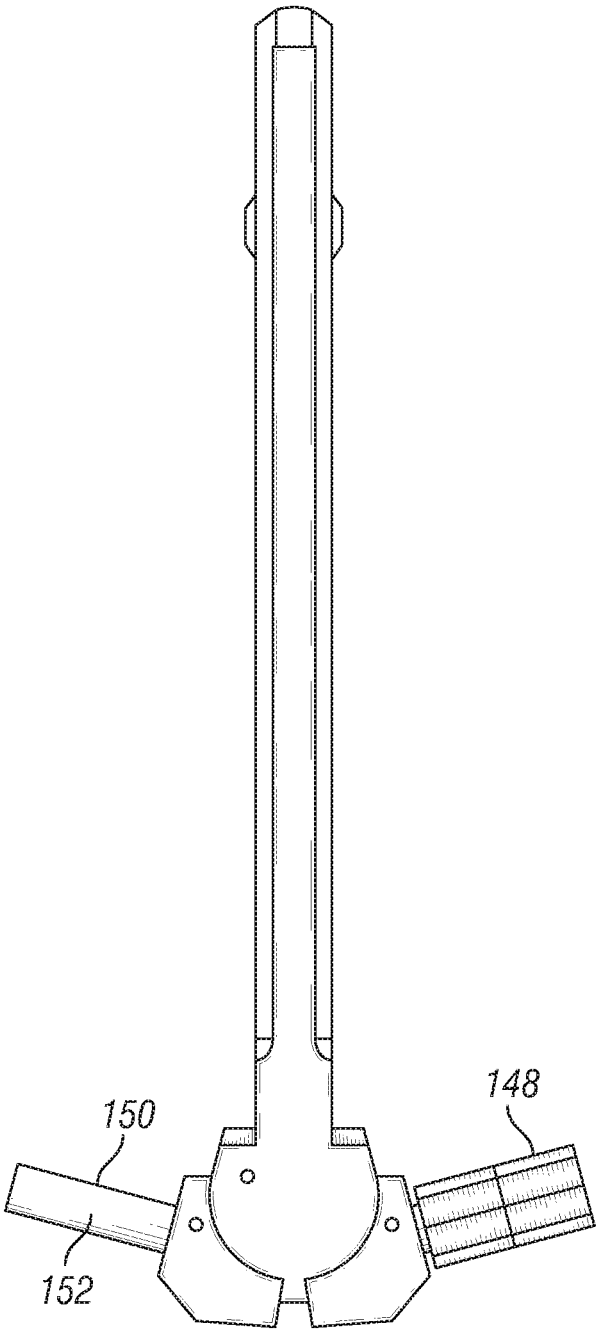
FIG. 6A depicts a top view of a charging handle in accordance with one or more embodiments of the disclosure.
Figure 6B:
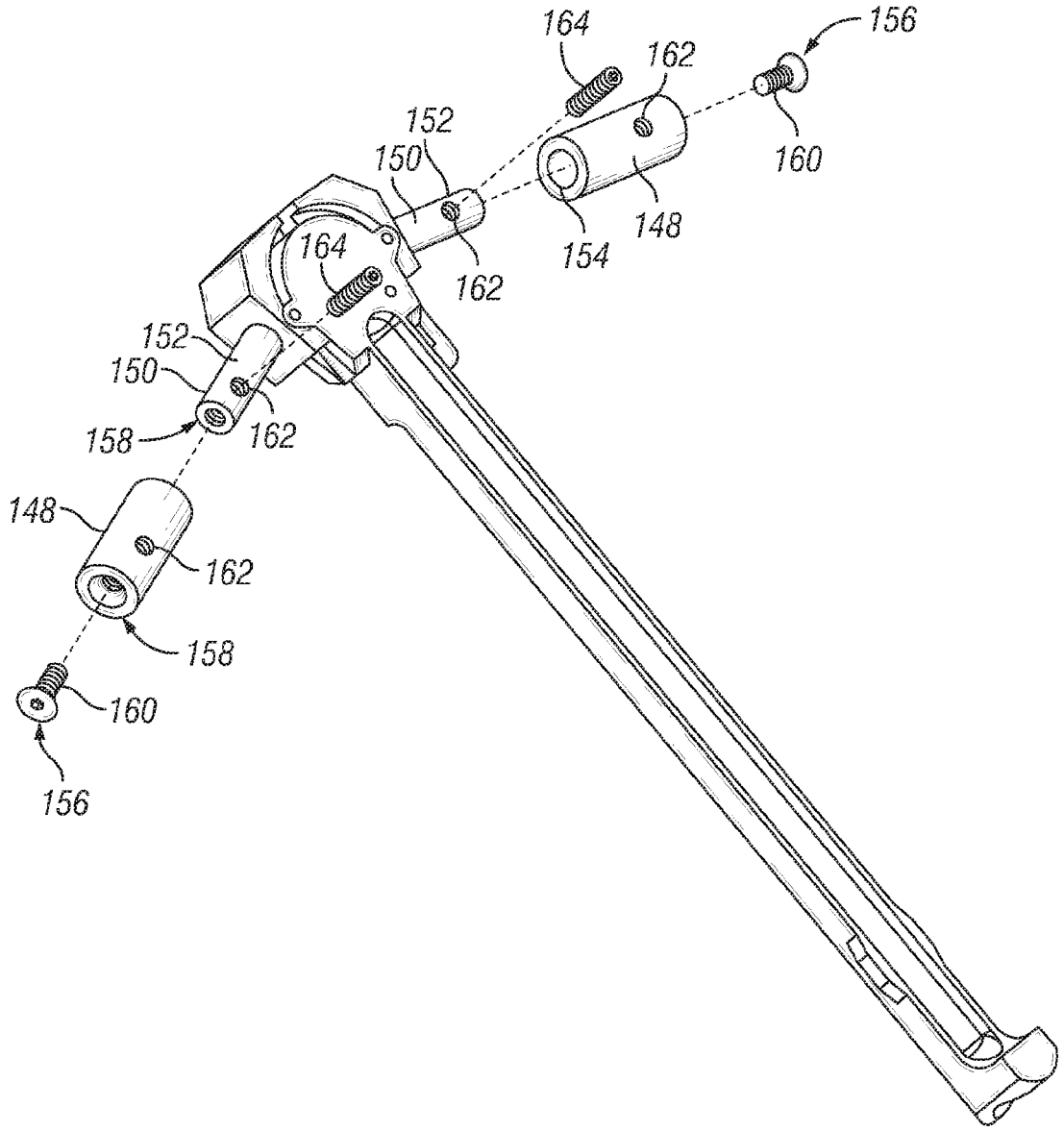
FIG. 6B depicts a partial exploded view of a charging handle in accordance with one or more embodiments of the disclosure.

As depicted in FIGS. 6A and 6B, the charging handle 100 may include interchangeable handles. That is, the first handle 124, the second handle 134, and/or portions thereof may be removed and replaced with a different handle or handle component. In this manner, a user may swap out different handles or portions thereof as desired. For example, as depicted in FIGS. 5-6B, the first handle 124, the second handle 134, or both may include a removable outer handle portion 148. The removable outer handle portion 148 may be attachable to an inner handle portion 150. In some instances, the inner handle portion 150 may comprise an outwardly extending protrusion 152, and the removable outer handle portion 148 may include an aperture 154 therein configured to mate with the outwardly extending protrusion 152. In addition, as depicted in FIGS. 1, 2, 5, and 6B, a fastener 156 assembly may be used to removably fasten the removable outer handle portion 148 to the inner handle portion 150. In some instances, the fastener 156 assembly may include a bore 158 extending through the removable outer handle portion 148 and the inner handle portion 150. The bore 158 may be parallel to the longitudinal axis of the first handle 124 and/or the second handle 134. The fastener assembly 156 also may include a screw 160 or the like securable within the bore 158 to removably attach the removable outer handle portion 148 to the inner handle portion 150. For example, the screw 160 may be threaded into the bore 158.

In some instances, a head of the screw 160 may at least partially nest within the bore 158 so as to be flush with the first handle 124 and/or the second handle 134. In other instances, the removable outer handle portion 148 may include internal threads that mate with external threads on an outer surface of the outwardly extending protrusion 152. In this manner, the removable outer handle portion 148 may be screwed directly onto the outwardly extending protrusion 152.

As depicted in FIG. 6B, the removable outer handle 148 and the outwardly extending protrusion 152 of the inner handle 150 may include a transverse bore 162 in which a set screw 164 may be threaded or the like to secure the removable outer handle 148 and the inner handle 150. As its name implies, the transverse bore 162 may be generally transverse to the longitudinal axis of the first handle 124 and/or the second handle 134. The transverse bore 162 and set screw 164 may be used in conjunction with or independent of the fastener 156 the bore 158, and vice versa. In this manner, the removable outer handle 148 may be attached and detached from the inner handle 150 using the bore 158, which is parallel to the longitudinal axis of the first handle 124 and/or the second handle 134, and/or the transverse bore 162, which is perpendicular to the first handle 124 and/or the second handle 134. Other types of attachment configurations are also possible.

Figure 7:
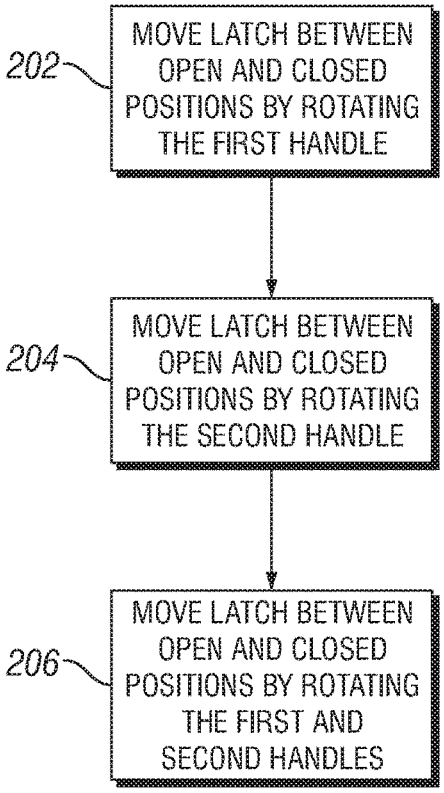
FIG. 7 is a flow diagram depicting an illustrative method for utilizing a charging handle in accordance with one or more embodiments of the disclosure.

FIG. 7 is a flow diagram depicting an illustrative method 200 for moving the latch 116 between the open position and the closed position in accordance with one or more embodiments of the disclosure.

At block 202 of method 200, the latch 116 may be moved between the open position and the closed position by rotating the first handle 124. For example, as the first handle 124 is rotated, the second end 130 of the first handle 124 may engage an end 144 of the latch 116 opposite the catch 120, which may move the latch 116 between the open and closed positions. At block 204, the latch 116 may be moved between the open position and the closed position by rotating the second handle 134. For example, as the second handle 134 is rotated, the second end 140 of the second handle 134 may engage the end 144 of the latch 116 opposite the catch 120, which may move the latch 116 between the open and closed positions. At block 206, the latch 116 may be moved between the open position and the closed position by rotating the first handle 124 and the second handle 134. In this manner, a user may manipulate (e.g., pivot) the first handle 124, the second handle 134, or both to move the latch 116 between the open position and the closed position. Accordingly, the latch assembly 114 is ambidextrous. The steps described in blocks 202-206 of method 200 may be performed in any order. Moreover, certain steps may be omitted, while other steps may be added.

Figure 8:
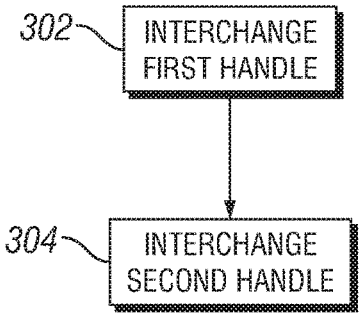
FIG. 8 is a flow diagram depicting an illustrative method for utilizing a charging handle in accordance with one or more embodiments of the disclosure.

FIG. 8 is a flow diagram depicting an illustrative method 300 for interchanging the handles of the charging handle 100 in accordance with one or more embodiments of the disclosure. At block 302 of method 300, the first handle 124 may be removed and/or replaced. For example, the screw 160 may be removed from the bore 158 to remove the removable outer handle portion 148 from the inner handle portion 150 of the first handle 124. In this manner, a different removable outer handle portion 148 may be attached to the inner handle portion 150 of the first handle 124. At block 304 of method 300, the second handle 134 may be removed and/or replaced. For example, the screw 160 may be removed from the bore 158 to remove the removable outer handle portion 148 from the inner handle portion 150 of the second handle 134. In this manner, a different removable outer handle portion 148 may be attached to the inner handle portion 150 of the second handle 134. The steps described in blocks 302 and 304 of method 300 may be performed in any order. Moreover, certain steps may be omitted, while other steps may be added.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A charging handle, comprising:

an elongated body having a forward end and a rear end;

a handle assembly attached to the rear end of the elongated body, wherein the handle assembly comprises a first handle pivotable attached to a first side of the handle assembly and a second handle pivotable attached to a second side of the handle assembly opposite the first handle, wherein the first handle or the second handle comprise a removable outer handle portion attachable to an inner handle portion; and a latch assembly attached to the rear end of the elongated body in mechanical communication with the handle assembly.

2. The charging handle of claim 1, wherein the latch assembly comprises a latch pivotably attached to the handle assembly, wherein the latch comprises a closed position and an open position.

3. The charging handle of claim 2, wherein the latch assembly comprises a spring configured to bias the latch in the closed position.

4. The charging handle of claim 2, wherein the first handle is configured to move the latch between the open position and the closed position independent of the second handle.

5. The charging handle of claim 4, wherein the second handle is configured to move the latch between the open position and the closed position independent of the first handle.

6. The charging handle of claim 5, wherein the second handle comprises a stop configured to engage an end of the latch to prevent over rotation of the latch beyond the open configuration.

7. The charging handle of claim 1, wherein the inner handle portion comprises an outwardly extending protrusion.

8. The charging handle of claim 7, wherein the removable outer handle portion comprises an aperture therein configured to mate with the outwardly extending protrusion.

9. The charging handle of claim 8, further comprising a fastener configured to removably fasten the removable outer handle portion to the inner handle portion.

10. A charging handle, comprising:

an elongated body having a forward end and a rear end;

a handle assembly attached to the rear end of the elongated body, wherein the handle assembly comprises at least one removable handle; and a latch assembly attached to the rear end of the elongated body in mechanical communication with the handle assembly, wherein the at least one handle comprise a removable outer handle portion attachable to an inner handle portion.

11. The charging handle of claim 10, wherein the inner handle portion comprises an outwardly extending protrusion.

12. The charging handle of claim 11, wherein the removable outer handle portion comprises an aperture therein configured to mate with the outwardly extending protrusion.

13. The charging handle of claim 12, further comprising a fastener configured to removably fasten the removable outer handle portion to the inner handle portion.

14. A charging handle, comprising:

an elongated body having a forward end and a rear end;

a handle assembly attached to the rear end of the elongated body, wherein the handle assembly comprises a first handle pivotable attached to a first side of the handle assembly and a second handle pivotable attached to a second side of the handle assembly opposite the first handle, wherein the first handle or the second handle comprise a removable outer handle portion attachable to an inner handle portion;

a latch pivotably attached to the handle assembly, wherein the latch comprises a closed position and an open position; and a spring configured to bias the latch in the closed position, wherein the first handle is configured to move the latch between the open position and the closed position independent of the second handle, and wherein the second handle is configured to move the latch between the open position and the closed position independent of the first handle.

15. The charging handle of claim 14, wherein the second handle comprises a stop configured to engage an end of the latch to prevent over rotation of the latch beyond the open configuration.

16. The charging handle of claim 14, wherein the inner handle portion comprises an outwardly extending protrusion, and wherein the removable outer handle portion comprises an aperture therein configured to mate with the outwardly extending protrusion.

17. A charging handle, comprising:

an elongated body having a forward end and a rear end;

a handle assembly attached to the rear end of the elongated body, wherein the handle assembly comprises a first handle attached to a first side of the handle assembly and a second handle attached to a second side of the handle assembly opposite the first handle, wherein the first handle or the second handle comprise a removable outer handle portion attachable to an inner handle portion; and a latch assembly attached to the rear end of the elongated body in mechanical communication with the handle assembly.

* * * * *